US007300110B1

(12) United States Patent
Debien

(10) Patent No.: US 7,300,110 B1
(45) Date of Patent: Nov. 27, 2007

(54) COLLAPSIBLE FURNITURE HAVING RESILIENT LOCKING BARBS

(76) Inventor: Fred R. Debien, 3037 Lown St. North, St. Petersburg, FL (US) 33713

( * ) Notice: Subject to any disclaimer, the term of this patent is extended or adjusted under 35 U.S.C. 154(b) by 611 days.

(21) Appl. No.: 10/888,865

(22) Filed: Jul. 12, 2004

(51) Int. Cl.
*A47C 7/00* (2006.01)

(52) U.S. Cl. ..... 297/440.13; 297/440.14; 297/440.2; 297/181

(58) Field of Classification Search ..... 297/440.13, 297/440.14, 440.15, 440.16, 440.2, 440.22, 297/181
See application file for complete search history.

(56) References Cited

U.S. PATENT DOCUMENTS 1,508,697 A * 9/1924 Junker ..... 297/332
1,747,900 A * 2/1930 Jenny ..... 297/440.13
2,518,955 A * 8/1950 Stelzer ..... 297/440.13
2,534,413 A * 12/1950 Cenis ..... 297/440.13
4,593,950 A * 6/1986 Infanti ..... 297/3
4,919,485 A * 4/1990 Guichon ..... 297/440.23
6,109,695 A * 8/2000 Kahwaji ..... 297/440.13
6,533,361 B1 * 3/2003 Pietrzak ..... 297/440.22
6,619,749 B2 * 9/2003 Willy ..... 297/440.13

* cited by examiner

*Primary Examiner*—Laurie K. Cranmer
(74) *Attorney, Agent, or Firm*—Thomas Frost

(57) ABSTRACT

Collapsible furniture assemblies having resilient locking barbs are provided. The furniture assemblies are comprised of plurality of panels that are interlockable by a plurality of registerable slots defined by the panels. The panels are further positively locked together in an assembled configuration by the incorporation of locking barbs into at least one panel of the furniture assembly which are received by at least one additional panel of the assembly. In multiple applications, several locking barbs are incorporated into different panels to positively lock the panels is an assembled configuration. Additionally, collapsible furniture assembles such as chairs, rocking chairs, beach chairs, desks, toy boxes, and cradles are provided, which include locking barbs. Panels of the furniture assemblies can be formed to simulate the profiles of animals and furniture sets comprising multiple different collapsible furniture assemblies and collapsible furniture assemblies which can be constructed into different types of furniture are provided.

10 Claims, 9 Drawing Sheets

COLLAPSIBLE FURNITURE HAVING RESILIENT LOCKING BARBS

BACKGROUND OF THE INVENTION

1. Field of the Invention

The present invention relates generally to collapsible furniture assemblies that are readily collapsed and reassembled. More particularly, relating to collapsible furniture assemblies including one or more resilient locking elements making the assembly and the collapsing of collapsible furniture assemblies easier and faster and which positively ensures the furniture will remain assembled until disassembly is desired.

2. Discussion of the Prior Art

Collapsible furniture assemblies are well known in the art and have become a common place in most households. Collapsible furniture are popular for many reasons, including but not limited to reduced consumer cost, reduced manufacture cost, reduced shipping cost, reduce storage space, ease of transport, and entertaining for children.

Over a number of years, collapsible furniture assemblies have seen many improvements and the following U.S. Patent Numbers are representative of the types of improvements that have occurred: U.S. Pat. Nos. 3,527,497; 3,909,064; 4,348,052; 4,593,950; 4,509,794; 5,387,027; 5,765,922; 5,927,816; 5,00,514; and 5,803,548.

While the above referenced patents do fulfill their particular objects, none of the patents either singularly or in combination disclose or make obvious a simplified locking feature for positively retaining all of the individual pieces of the each collapsible furniture assembly together. Furthermore, none of the patents either singularly or in combination disclose or make obvious such a simplified locking feature that can be incorporated into many different types of collapsible furniture without substantial modification.

As such the collapsible furniture of the present invention includes a new, novel, and unobvious locking feature for positively retaining all of the individual pieces of the collapsible furniture assembly together and which includes such a locking feature that can be incorporated into an unlimited number of types of collapsible furniture.

SUMMARY OF THE INVENTION

In accordance with the present invention, improved collapsible furniture is provided having a locking feature for positively retaining all of the individual pieces of the collapsible furniture assembly together and which includes such a locking feature that can be incorporated into an unlimited number of types of collapsible furniture.

More specifically, in one application, an improved collapsible furniture is provided having at least the following pieces: a pair of planer side panels, a seat panel interlockable with the pair of side panels by a plurality of a first set of registerable slots and a back panel interlockable with the pair of side panels by a plurality of a second set of registerable slots and where the back panel is interlockable with the seat panel. The seat panel includes an aperture and the back panel includes a pair of resilient locking barbs projecting therefrom, wherein the resilient barbs are inserted through the aperture during an operation of interlocking the back panel with the side panels by the second set of registerable slots so that the pair of locking barbs are received by the aperture and lock the removal of the seat panel from the pair of planer side panels and lock the removal of the back panel from the second set of registerable slots, thereby locking the collapsible furniture together in an assembled configuration.

With this arrangement, regardless of how the furniture is pickup, moved, or transported, the individual pieces are positively locked together by the unique assembly including a single key piece being assembled with the remain furniture pieces as the last piece, which includes the locking barbs that are received by a second, already assembled furniture piece to lock all of the remaining assembled pieces together. The resilient locking barbs bended to a deflected position when inserted into the aperture and return to a non-deflected, locked position in abutment with the second piece. In order to disassemble the furniture, the locking barbs must be bent back into the deflected position while simultaneously lifting the first piece from the furniture assembly to remove the barbs from the second piece.

An additional unique aspect of the locking feature is the ease in which the furniture assembly is assembled and locked together. In fact the operation of assembling and locking the assembly together is so easy and simple it is well suited for a young child to perform the operation. However, the disassembly and unlocking of the furniture assembly does require a higher degree of dexterity so that a young child while can assemble the furniture is unlikely able to disassemble the furniture without the aid of an adult. This affords a safety feature in that furniture will not unexpectedly become disassembled, which other wise could result in injury to a user.

As mentioned infra, the locking feature can be incorporated into many different types of collapsible furniture. By way of example, the collapsible furniture can include but is not limited to a chair, a desk, a table, a rocking chair, a beach chair, a cradle, a toy box, a roll desk and the like.

Additionally, the furniture can take on the shape of animal to enhance the entertainment of the collapsible furniture. In the case of the furniture simulating an animal shape, a decalcomania may also be provided, which includes detailed features of the particular animal.

By way of example in how key locking feature can be incorporated into many different configurations of collapsible furniture, an additional embodiment of a collapsible furniture is provided. In this embodiment, the collapsible furniture has at least the following pieces: a pair of planer side panels, a first horizontal panel interlockable to the pair of planer side panels by a first set of registerable slots defined by the first horizontal panel and by the pair of planer side panels, a second horizontal panel interlockable to the pair of planer side panels by a second set of registerable slots defined by the second horizontal panel and by the pair of planer side panels, a back panel interlockable to the pair of planer side panels by a third set of registerable slots defined by the back panel and by the pair of planer side panels, where the back panel includes a pair of resilient locking barbs projecting therefrom. The pair of resilient locking barbs being received by at least one aperture formed through the second horizontal panel during an operation of interlocking the back panel with the side panels by the third set of registerable slots so that the pair of locking barbs are received by the pair of apertures and lock the removal of the first horizontal panel from the pair of planer side panels, of the second horizontal panel from the pair of planer side panels and lock the removal of the back panel from the third set of registerable slots, thereby locking the collapsible desk together in an assembled configuration.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
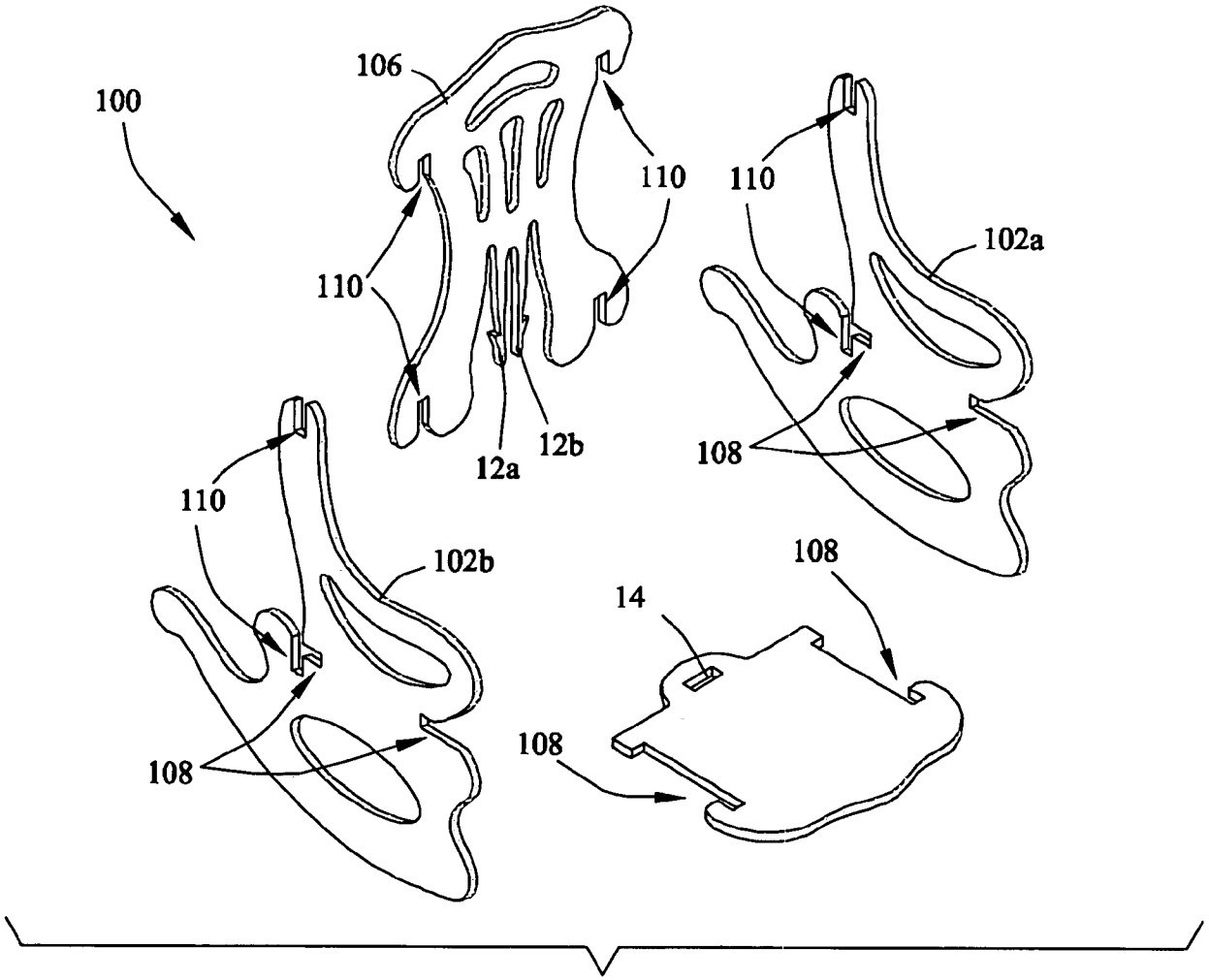
FIG. 1 is an exploded perspective view of a collapsible rocking chair constructed in accordance with the principles of the present invention.
Figure 3:
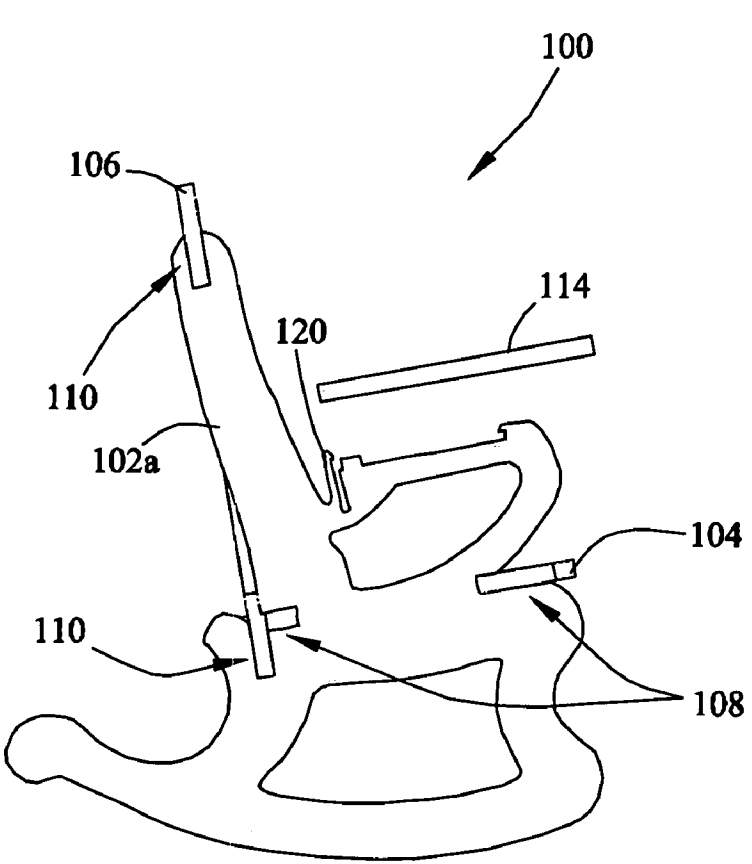
FIG. 3 is side plan view of an additional embodiment of the rocking chair of FIGS. 1 and 2.
Figure 2:
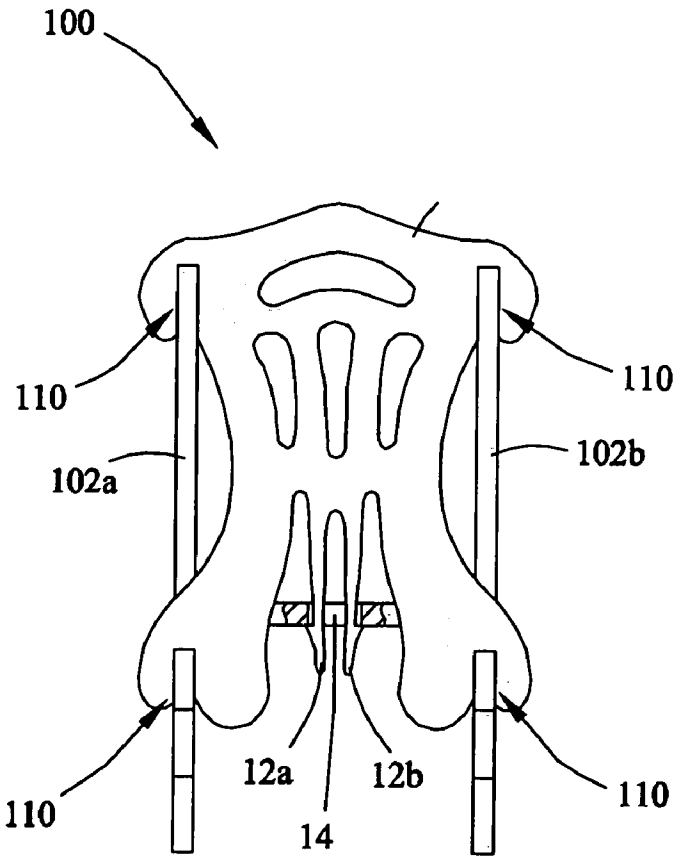
FIG. 2 is a rear elevation view of the rocking chair of FIG. 1 assembled.

Referring now to the drawings, and particularly to FIGS. 1-3, which illustrates a first embodiment of an improved collapsible furniture assembly 100 incorporating a positive locking feature 10 of the present invention.

The collapsible furniture assembly 100, illustrated as a rocking chair as one of a few different collapsible furniture assemblies that will be described herein in order to illustrate the capability of incorporating resilient locking barbs 10 for interlocking at least one furniture element to another furniture element into numerous different types of collapsible furniture, including but not limited to a chair, a desk, a table, a rocking chair, a beach chair, a cradle, a toy box, a roll desk and the like, without substantial modification. While many different collapsible furniture assemblies will be described herein, it is to be understood that each assembly is being described by way of example and that the claims appended herewith should not be limited to the particularly described examples. As it will be clearly understood that various modifications may be made without departing from the scope of the invention and that other embodiments are within the scope of the appended claims.

In FIG. 1, the collapsible furniture assembly 100 includes a pair of planer side panels 102*a* and 102*b*, a seat panel 104 and a back panel 106. The side panels 102*a* and 102*b* are substantially identical and can be formed to include many different ornament curvatures. The side panels 102*a* and 102*b* are interlockable with the seat panel 104 by a first set of registerable slots generally designated by the reference numeral 108, which are formed into the seat panel and each side panel. Preferably, the first set of registerable slots 108 are formed generally longitudinally in the side panels 102*a* and 102*b*. The back panel 106 is also interlockable with the side panels 102*a* and 102*b* by a second set of registerable slots generally designated by the numeral 110, which are formed into the back panel and each side panel. Preferably, the second set of registerable slots are formed generally vertically into the side panels 102*a* and 102*b* and the back panel 106.

The back panel 106 further includes of a pair of resilient locking barbs 12*a* and 12*b* which project from the back panel. Preferably, the locking barbs 12 extend from the back panel 106 substantially parallel to one another and at a predetermined spaced distance. The locking barbs 12 can be integrally formed with the back panel 106 or can be of a separate piece comprising both barbs which is attached to the back panel or each barb can be of a separate piece attachable to the back panel. Most preferably, the locking barbs 12 are facing in opposite directions and extend downwardly from the back panel 106.

The seat panel 104 further includes an aperture 14 formed therethrough towards a rear side 112. The aperture 14 is adapted to receive the locking barbs 12 during an operation of interlocking the back panel 106 to the side panels 102*a* and 102*b* by alignment of and the insertion of the second set of registerable slots 110. During assembly, the seat panel 104 would first be interlocked with one side panel 102*a* or 102*b* by the associated first set of registerable slots 108 and then would be interlocked with the second side panel in the same fashion. The back panel 106 is the last piece assembled with the furniture assembly 100 and by insertion of the locking barbs 12 into the aperture 14 the entire furniture assembly is positively locked together.

Turning to FIG. 2, the collapsible furniture assembly 100 is illustrated assembled with a partial cross section of the rear elevation thereof shown. In this view, the seat panel 104 is interlocked with the side panels 102*a* and 102*b*, the back panel 106 is interlocked with the side panels and the barbs 12 extending from the back panel are completely inserted into the aperture 14 and positively locked therein. With the barbs 12 locked into the aperture 14, the back panel 106 is locked to the seat panel 104 which further locks each side panel 102*a* and 102*b* to the back panel and the seat panel, thereby retaining and locking the entire furniture assembly in the assembled configuration.

Unlike prior art collapsible furniture assemblies, which have a common problem with inadvertently becoming partially or completely disassembled by simple movement or lifting, the pieces of the furniture assembly 100 will remain locked together regardless of how the assembled furniture is moved or oriented. Additionally, the furniture assembly 100 with the incorporation of the locking barbs 12*a* and 12*b* is easily assembled and locked in the assembled configuration without the use of tools or mechanical fasteners, such as screws.

To disassemble the furniture assembly 100, the locking barbs 12*a* and 12*b* must be pressed in a direction towards one another while simultaneously lifting the back panel 106 from the side panels 102*a* and 102*b* to remove the barbs from the aperture 14, thereby unlocking the assembly 100 for disassembly. This dual motion requirement for unlocking the furniture assembly 100 insures that the assembly will not inadvertently become disassembly, thereby affording a high degree of safety to the user. This is especially important when the furniture assembly 100 is a piece of children's furniture.

Turning now to FIG. 3, a side elevation view of a second example of the collapsible furniture assembly 100 is illustrated, which is of a differently shaped rocking chair. In this example, the side panels 102*a* and 102*b* are shown with different ornamental curvatures then previously illustrated. Furthermore, an optional, detachable arm rest panel 114 can be provided, which is removably attached to a side panel 102*a* or 102*b*. Preferably, an arm rest panel 114 is provided for both side panels 102*a* and 102*b*. Most preferably, each arm rest panel 114 is attached to each side panel 102*a* and 102*b* by at least one resilient locking barb 120 incorporated into and extending upwardly from each side panel, which is received by the arm rest panel to lock the arm rest panel to the side panel.

Figure 4:
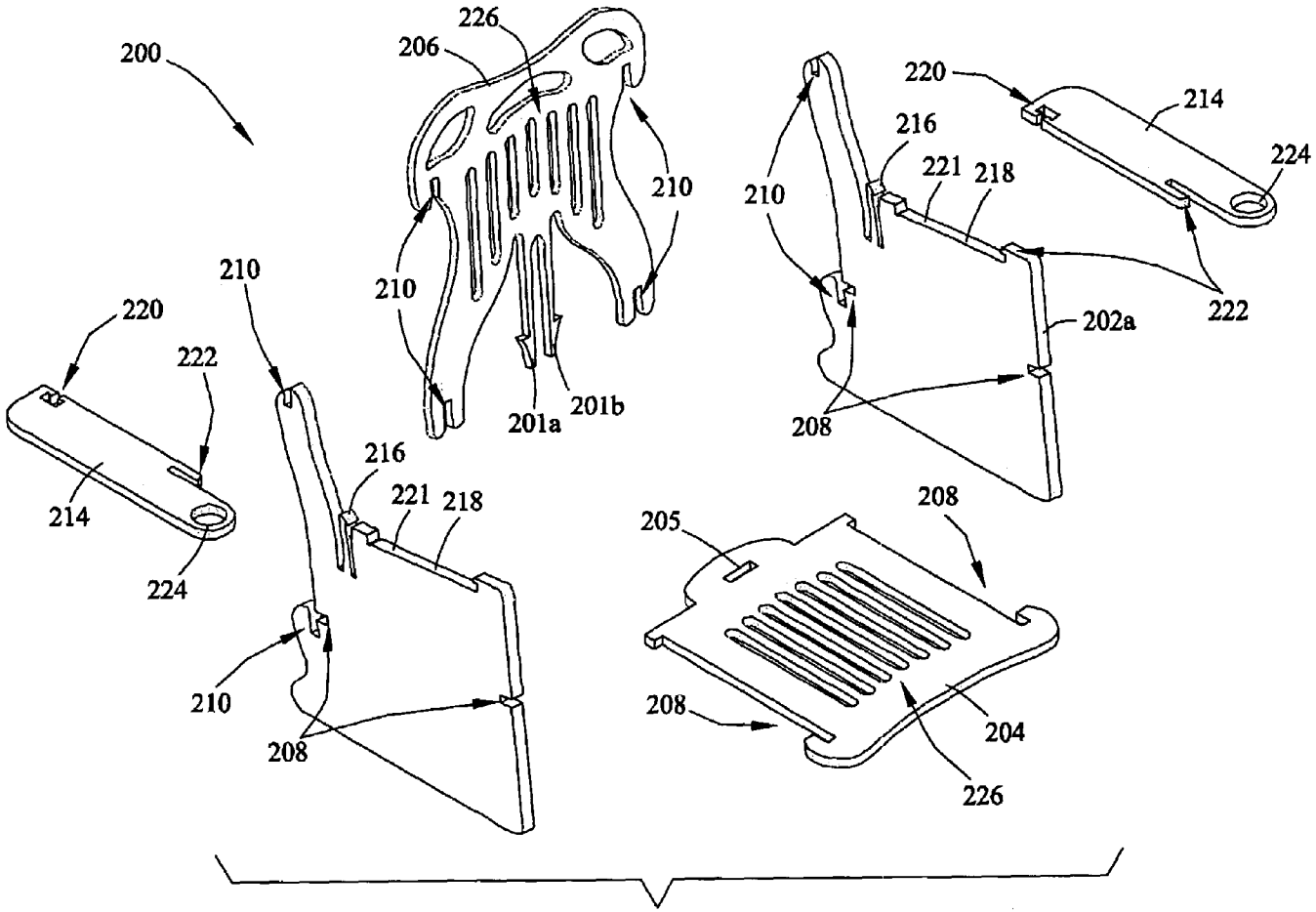
FIG. 4 is an exploded perspective view of a collapsible beach chair constructed in accordance with the principles of the present invention.

With reference now to FIG. 4, a third example of a collapsible furniture assembly 200 is illustrated, which is of a beach chair. In this example a pair of planer side panels 202*a* and 202*b*, a seat panel 204, a back panel 206, and optionally a pair of arm rest panels 214 are included in the assembly 200. The side panels 202*a* and 202*b* are interlockable with the seat panel 204 by a first set of registerable slots generally designated by the reference numeral 208, which are formed into the seat panel and each side panel. Preferably, the first set of registerable slots 208 are formed generally longitudinally in the side panels 202*a* and 202*b*. The back panel 206 is also interlockable with the side panels 202*a* and 202*b* by a second set of registerable slots generally designated by the numeral 210, which are also formed into the back panel and each side panel. Preferably, the second set of registerable slots 210 are formed generally vertically into the side panels 202*a* and 202*b* and the back panel 206.

The back panel 206 further includes a pair of resilient locking barbs 201*a* and 201*b* which extend from the back panel. Preferably, the locking barbs 12 extend from the back panel 206 substantially parallel to one another at a predetermined spaced distance. The locking barbs 201*a* and 201*b* can be integrally formed with the back panel 206 or can be of a separate piece comprising both barbs which is attached to the back panel or each barb can be of a separate piece attachable to the back panel. Most preferably, the locking barbs 201*a* and 201*b* are facing in opposite directions and extend downwardly from the back panel 206.

The seat panel 204 further includes an aperture 205 formed therethrough towards a rear side 213. The aperture 205 is adapted to receive the locking barbs 201*a* and 201*b* during an operation of interlocking the back panel 206 to the side panels 202*a* and 202*b* by alignment of and the insertion of the second set of registerable slots 210. During assembly, the seat panel 204 would first be interlocked with one side panel 202*a* or 202*b* by the associated first set of registerable slots 208 and then would be interlocked with the second side panel in the same fashion. The back panel 206 is the last structural piece assembled with the furniture assembly 200 and by insertion of the locking barbs 201*a* and 201*b* into the aperture 205 the entire furniture assembly is positively locked together.

If the optional arm rest panels 214 are provided in the furniture assembly 200, each side panel 202*a* and 202*b* further includes an additional resilient locking barb 216 extending upwardly from a top surface 218 thereof. The locking barb 216 is received by an aperture 220 formed into the arm rest panel 214. Preferably, each side panel 202*a* and 202*b* also include a recessed portion 221 formed into the top surface 218 to which an arm rest panel 214 is positioned. Most preferably, the arm rest panel 214 is interlockable with the side panel 202*a* or 202*b* by a fourth set of registerable slots 222, which are formed into the arm rest panels and each side panel. A cup holder 224 can also be formed into each arm rest panel 214. Additionally, longitudinal venting slots 226 can be formed through a central portion of the back panel 206 and through a central portion of the seat panel 204.

Figure 7:
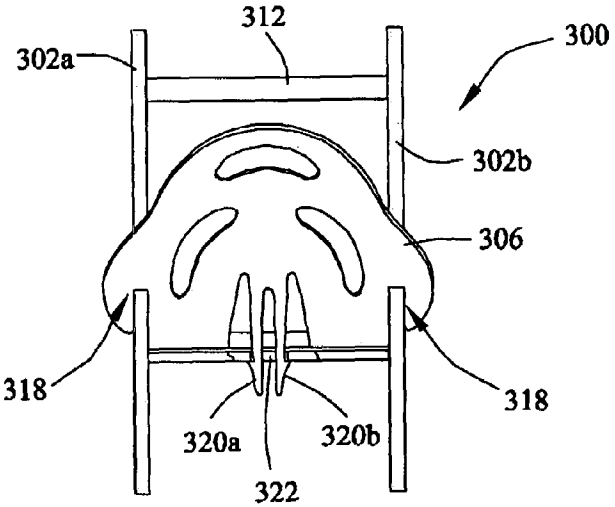
FIG. 7 is a rear elevation view thereof.
Figure 5:
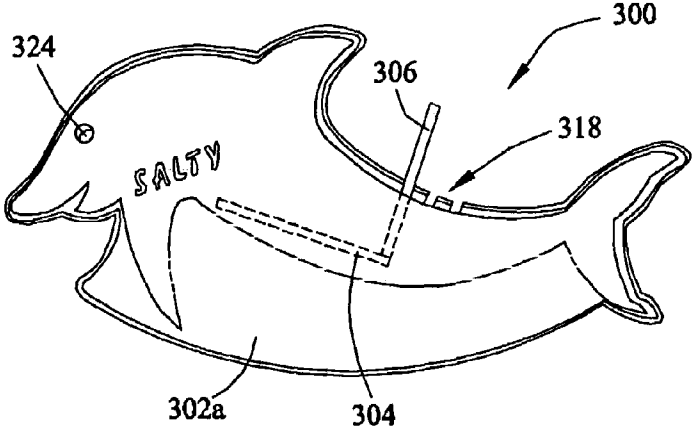
FIG. 5 is a side elevation view of an additional variation of a rocking chair which is constructed to resemble an animal.
Figure 6:
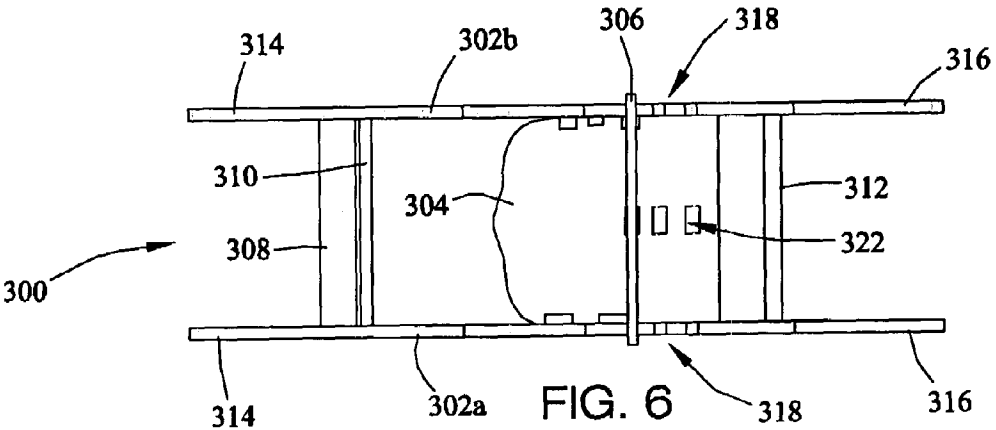
FIG. 6 is a top plan view of the rocking chair of FIG. 5.

Turning now to FIGS. 5, 6 and 7, a fourth example of a collapsible furniture assembly 300 is illustrated, which is of a child's rocking chair having a side profile of an animal, such as a dolphin. The furniture assembly 300 includes a pair of planer side panels 302*a* and 302*b*, a seat panel 304, a back panel 306, a foot bar 308, a hand bar 310, and a rear support bar 312. The seat panel 304 is connected to and between the pair of planer side panels 302*a* and 302*b* approximately midway between the ends 314 and 316 of each side panel. The foot bar 308 and the hand bar 310 are connected to and between the pair of planer side panel 302*a* and 302*b* approximate the ends 314 of the side panels. The rear support bar 312 is connected to and between the side panels 302*a* and 302*b* approximate the ends 316 of the side panels.

The back panel 306 is interlockable with the side panels 302*a* and 302*b* by a plurality of a first set of registerable slots generally designated by the reference numeral 318. The back panel 306 further includes a pair of resilient locking barbs 320*a* and 320*b* which extended downwardly therefrom, and which are received by one of a plurality of apertures 322 formed through the seat panel 304. Preferably, the apertures 322 are formed through the seat panel 304 so that they are orientated perpendicular to the side panels 302*a* and 302*b* when the seat panel is attached to the side panels. Most preferably, the apertures 322 are formed through the seat panel 304 so that the apertures are aligned with the first set of registerable slots 318 when the seat panel is attached to the side panels 302*a* and 302*b*. The back panel 306 is interlocked with the furniture assembly 300 by alignment of the first set of registerable slots 318 and by insertion of the locking barbs 320 into one of the corresponding apertures 322. The back panel 306 is selectively positionable along the seat panel 304 to adjust the distance between the back panel and the foot panel 308 and the hand bar 310 to accommodate children of different heights. Preferably, the back panel 306 is interlocked with the side panels 302*a* and 302*b* and the seat panel 304 so that the back panel and seat panel are normal to each other.

The side panels 302*a* and 302*b* are formed to simulate the profile of a particular animal, such as a dolphin. The side panels 302*a* and 302*b* of the furniture assembly 300 are illustrated in the form of a dolphin for exemplary purposes only, as one of ordinary skill in the art will readily appreciate the side panels could be formed to the profile shape of any animal. Additionally, a decalcomania 324 having feature details of a particular animal can be provided and attached to the side panels 302*a* and 302*b* to provide a more realistic appearance to the animal shaped side panels.

Figure 8:
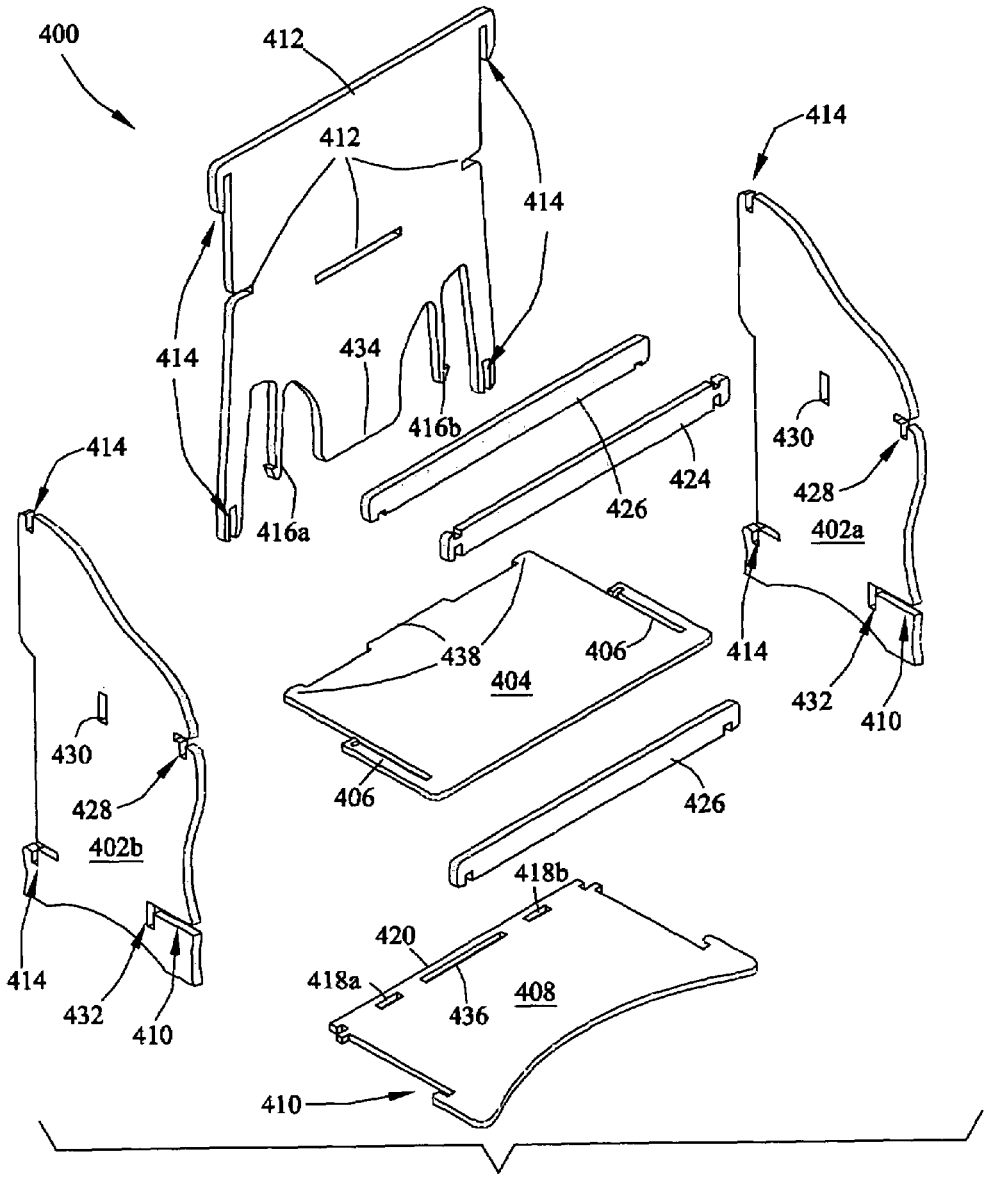
FIG. 8 is an exploded perspective view of a collapsible desk which is constructed in accordance with the principals of the present invention.

Now turning to FIG. 8, a fifth example of a collapsible furniture assembly is illustrated and generally indicated by the reference numeral 400. The furniture assembly 400 is of a collapsible desk having a pair of planer side panels 402*a* and 402*b*, a first horizontal panel 404 interlockable to the pair of planer side panels by a first set of registerable slots 406 defined by the first horizontal panel and by the pair of planer side panels, a second horizontal panel 408 interlockable to the pair of planer side panels by a second set of registerable slots 410 defined by the second horizontal panel and by the pair of planer side panels, a back panel 412 interlockable to the pair of planer side panels by a third set of registerable slots 414 defined by the back panel and by the pair of planer side panels.

The back panel 412 includes a pair of resilient barbs 416*a* and 416*b* which extend downwardly therefrom at a spaced distance. Preferably, the barbs 416*a* and 416*b* are facing in opposite and outward directions. The barbs are received by a pair of apertures 418*a* and 418*b* formed along a rear side 420 of the second horizontal panel 408 during an operation of interlocking the back panel to the side panels 402*a* and 402*b* by the third set of registerable slots 414, thereby locking the back panel to the side panels and the second horizontal panel.

The furniture assembly 400 can also include a first support arm 422, a second support arm 424, and a third support arm 426. The first support arm 422 is interlockable with the side panels 402*a* and 402*b* by a fourth set of registerable slots 428, defined by the first support arm and the side panel, so that the first support arm is positioned below and in abutment with the first horizontal panel 404. The second support arm 424 is interlockable with the side panels 402*a* and 402*b* by a fifth set of registerable slots 430, defined by the second support arm and the side panels so that the second support arm is positioned below and in abutment with the first horizontal panel 404. The third support arm 426 is interlockable with the side panels 402*a* and 402*b* by a sixth set of registerable slots 432, defined by the third support arm and the side panels, so that the third support arm is positioned below and in abutment with the second horizontal panel 408.

The back panel 412 can include a downwardly extending tongue 434 which is received by a tongue receiving slot 436 formed through the second horizontal panel 408 along the rear side 420 thereof. Most preferably, the tongue receiving slot 436 is formed through the second horizontal panel 408 between the apertures 418*a* and 418*b*.

The first horizontal panel 404 can include a plurality projections 438 that extend from a rear side 440 thereof, which are received by cooperating projection receiving slots 442 formed through the back panel 412 when the back panel is interlocked with the side panels 402*a* and 402*b* and the second horizontal panel 408 to further support the rear side thereof.

The side panels 402*a* and 402*b*, like the side panels 302*a* and 302*b* of the furniture assembly 300, can also be formed to resemble the profile of an animal, such as a dolphin. This aspect is not illustrated along with this furniture assembly 400 as it is believed the discussion thereof made along with furniture assembly 300 above is sufficient for one of ordinary skill in the art to make the side panels 402*a* and 402*b* to simulate a profile of an animal. Furthermore, a decalcomania having feature details can also be provided and attached to the side panels 402*a* and 402*b* as described above with the side panels 302*a* and 302*b*.

Figure 9A:
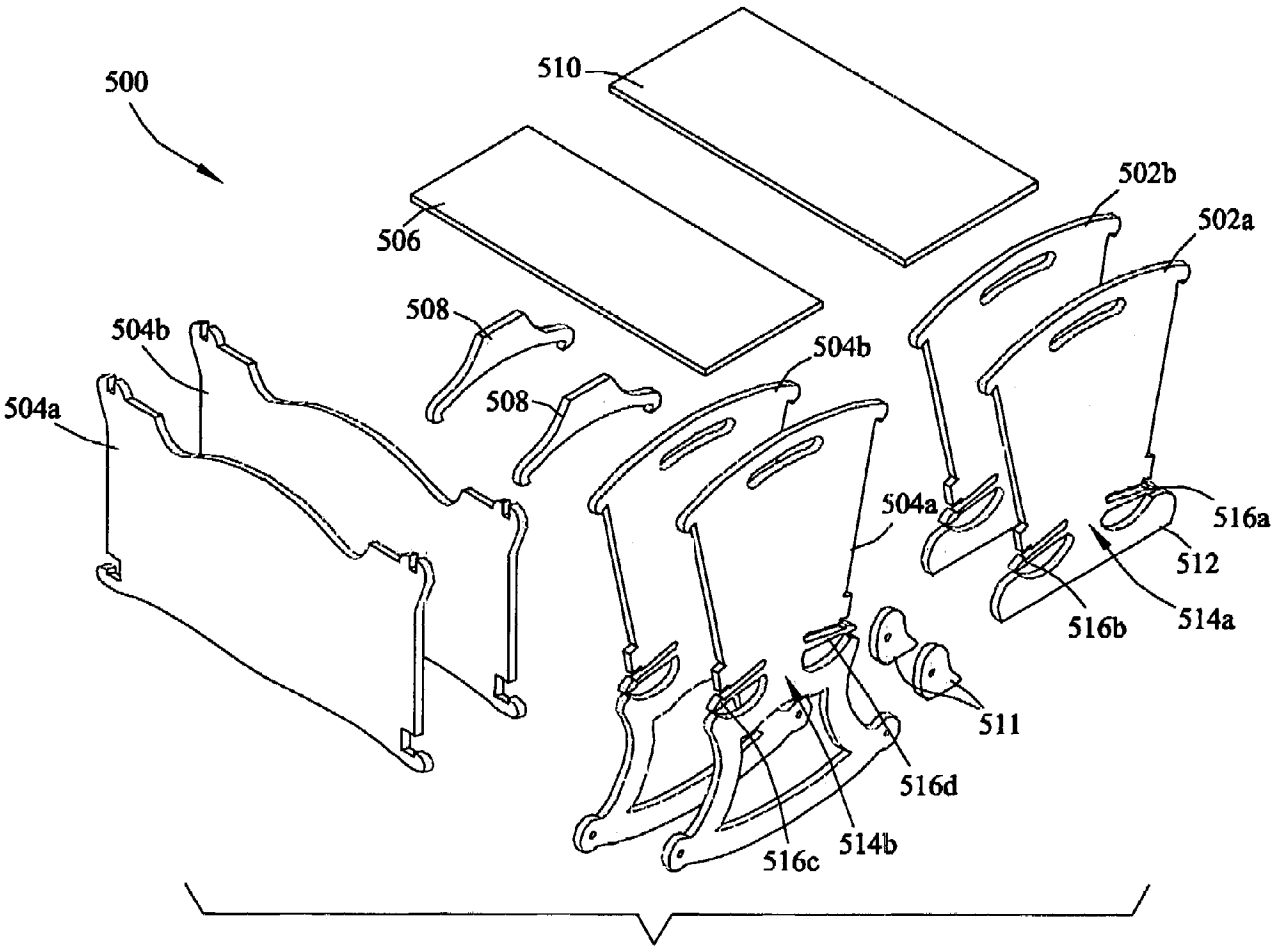
FIG. 9*a* an exploded perspective view collapsible furniture set that can be assembled as a toy box or as a cradle.

With reference now to FIG. 9*a*, a seventh example of a collapsible furniture assembly is illustrated and is generally indicated by the reference numeral 500. The furniture assembly 500 is a set which can be constructed either as a toy box or a cradle. The assembly 500 includes a first set of planer end panels 502*a* and 502*b*, a second set of planer end panels 502*c* and 502*d*, a pair of planer side panels 504*a* and 504*b*, a bottom panel 506, a pair of locking panels 508 and optionally a cover 510 and cradle stops 511, which are attachable to panels 502*c* and 502*d*. The furniture assembly 500 is constructed as a toy box when the side panels 502*a* and 502*b* are used and as a cradle when side panels 502*c* and 502*d* are used.

Each end panel 502*a* and 502*b* are of identical construction and each include a support leg 512 having a flat bottom attached to a narrowed bottom portion 514 each end panel. A pair of locking barbs 516*a* and 516*b* extend outwardly from opposite sides of the narrowed bottom portion 514*a*. Each side end 502*c* and 502*b* are of identical construction and have essentially the same construction as end panels 502*a* and 502*b* with the exception of a rocking cradle leg 516 attached to the narrowed bottom portion 514*b* of each end panel. Additionally, a pair of locking barbs 516*c* and 516*b* extend from the narrowed portion 514*b* of each end panel 502*c* and 502*d*.

Figure 9B:
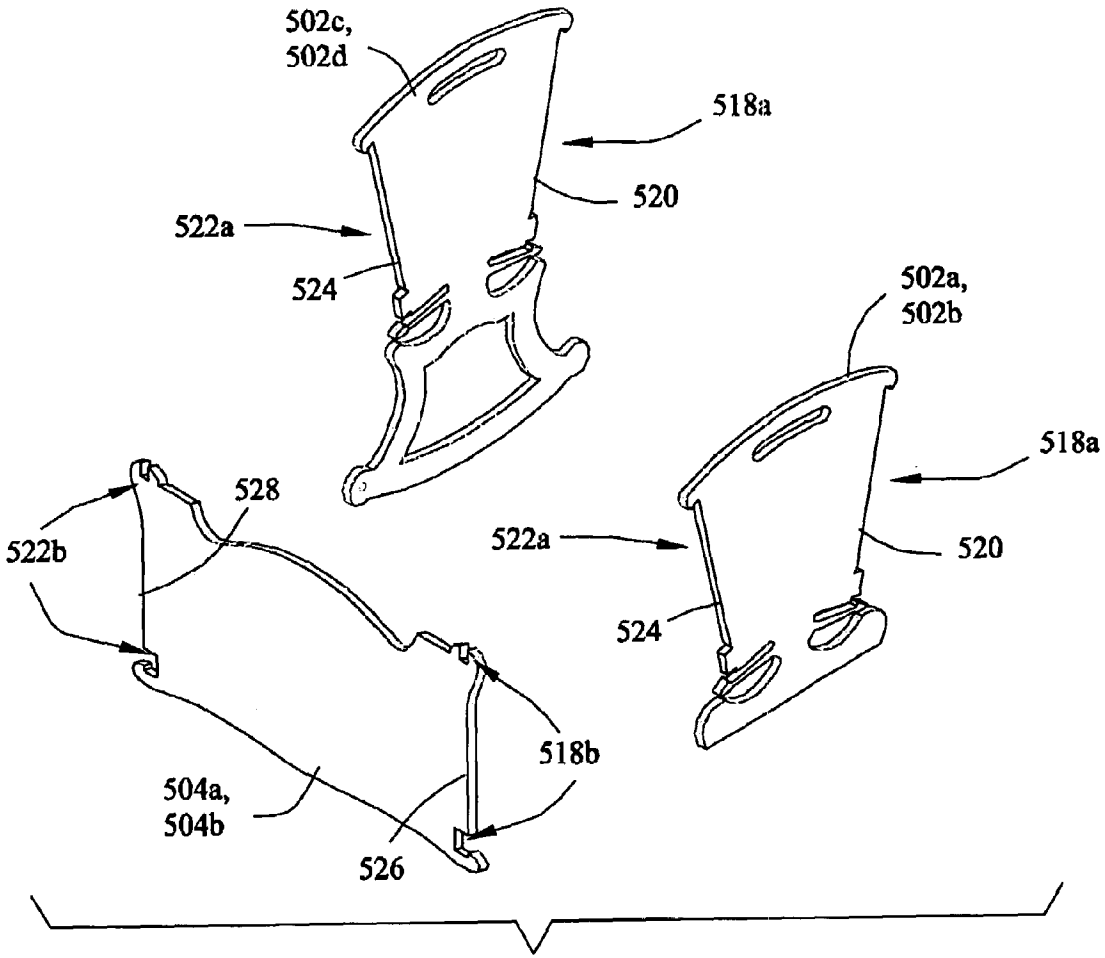
FIG. 9*b* an exploded detail perspective view of FIG. 9*a;*

Turning now to FIG. 9*b*, each end panel 502*a*, 502*b*, 502*c* and 502*d* define a first set of registerable slots 518*a* formed into a first longitudinal edge 520 thereof and a second set of registerable slots 522*a* formed into an opposed second longitudinal edge 524 thereof. The first and second set of registerable slots 518*a* and 522*b* are of identical construction and are interlockable to a matting set of first registerable slots 518*b* formed in a first edge 526 of each side panel 504*a* and 504*b* and to a matting set of second registerable slots 522*b* formed in a second edge 528 of each side panel 504*a* and 504*b*.

Figure 11:
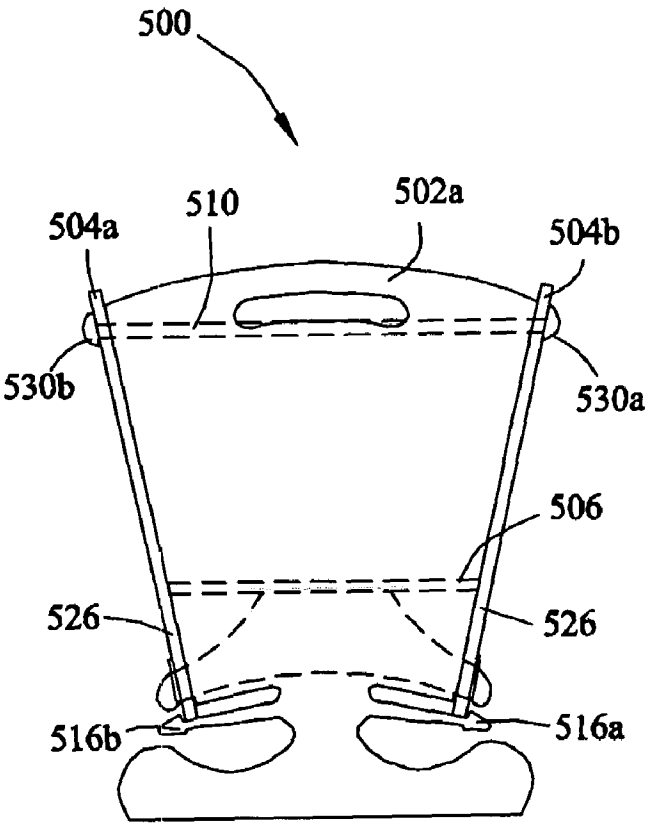
FIG. 11 is an end elevation view of the toy box assembled.
Figure 10:
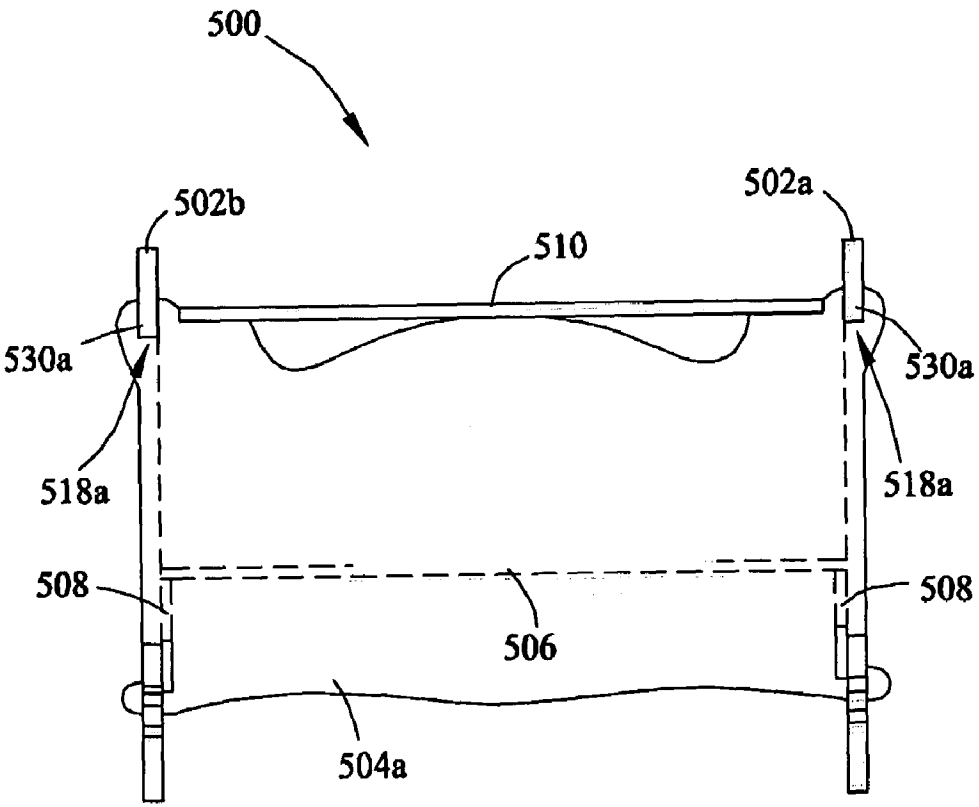
FIG. 10 is side elevation view of the toy box assembled.

Referring now to FIGS. 10 and 11, the construction of the furniture assembly 500 as the toy box is illustrated and will be described. To construct the toy box, end panels 502*a* and 502*b* are interlocked with the side panels 504*a* and 504*b* by engagement of the first set of registerable slots 518*a* and 518*b* and by engagement of the second set of registerable slots 522*a* and 522*b*. The barbs 516*a* and 516*b* engage the bottoms of each edge 526 and 528 of the side panels 504*a* and 504*b* to lock the side panels to each end panel 502*a* and 502*b*. Preferably, the slots 518*a* and 518*b* include a downward projecting edge 530*a* and 530*b* which engage the tops of each edge 526 and 528 of the side panels 504*a* and 504*b* to further lock the side panels to the end panels 502*a* and 502*b*. Then locking panels 508, one each is engaged with end side panels 504*a* and 504*b* towards the end panels 502*a* and 502*b* to further retain the side panels in engagement with the end panels and to provide a flat and smooth surface for the bottom panel 506 to be set upon. If the cover is provided 510, it is attached to each side panel 504*a* and 504*b*, as illustrated.

Figure 13:
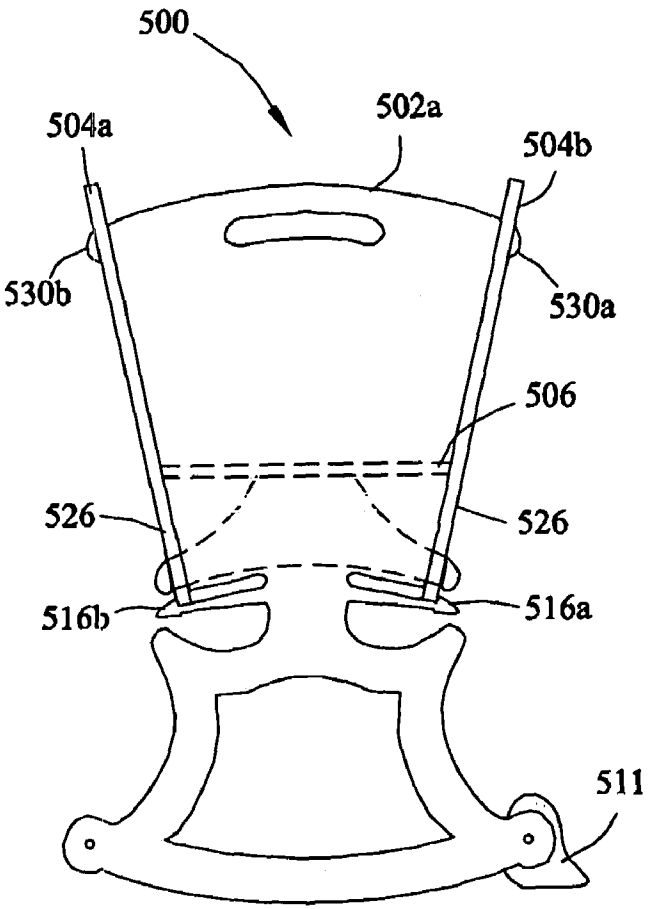
FIG. 13 is an end elevation view of the cradle assembled.
Figure 12:
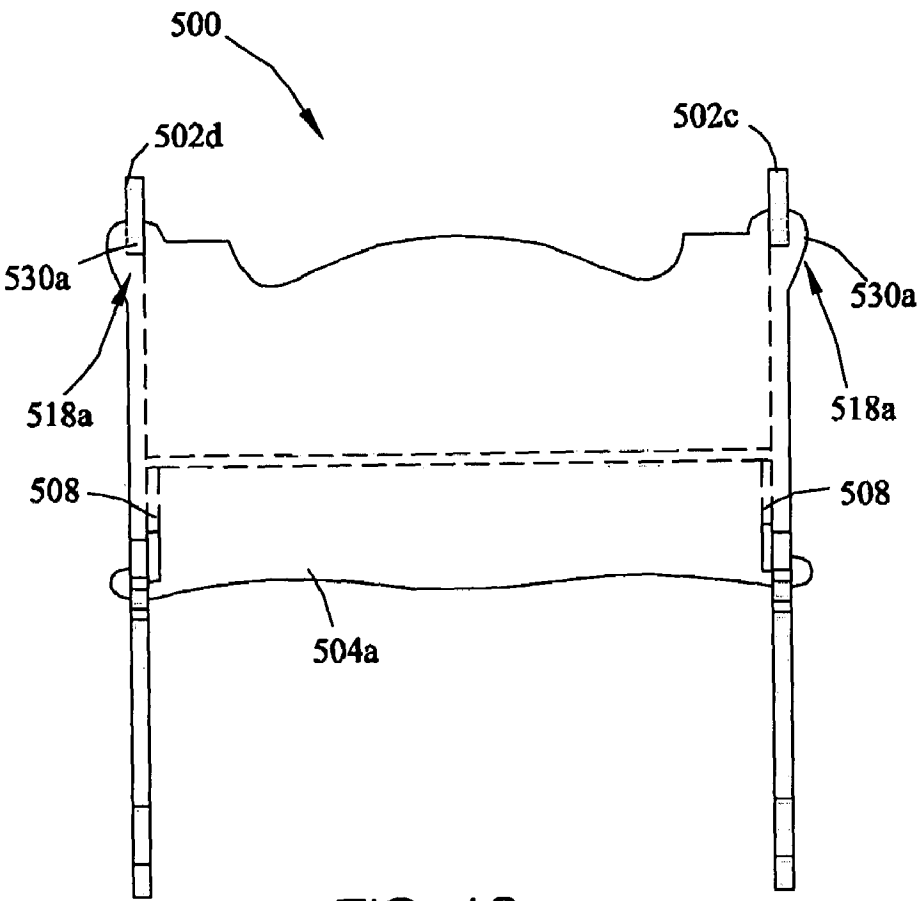
FIG. 12 is a side elevation view of the cradle assembled.

With reference to FIGS. 12 and 13, the cradle is constructed in the very same manner as the toy box, with the exception end panels 502*c* and 502*d* are used in place of end panels 502*a* and 502*b*. Additionally, in the cradle construction, a pair rocker stops 530 can be included for attachment to a common edge of the end panels 502*c* and 502*d* along the cradle leg 516 so as to restrain the cradle from rocking.

It is also contemplated that one or more separate collapsible furniture assemblies can be provided in a set of collapsible furniture. As an example, a collapsible chair assembly could be provided along with a collapsible desk assembly to provide a chair and desk set.

A number of embodiments of the present invention have been described. Nevertheless, it will be understood that various modifications may be made without departing from the spirit and scope of the invention. Accordingly, other embodiments are within the scope of the following claims.

I claim:

1. An improved collapsible furniture having at least a pair of planer side panels, a seat panel interlockable with the pair of side panels by a plurality of a first set of registerable slots and a back panel interlockable with the pair of side panels by a plurality of a second set of registerable slots and where the back panel is interlocked with the seat panel, the improvement comprising:

said seat panel defining an aperture; and said back panel having a pair of resilient locking barbs projecting therefrom, wherein said resilient barbs are inserted through said aperture during the operation of interlocking said back panel with said side panels by said second set of registerable slots so that said pair of locking barbs are received by said aperture and lock the removal of said seat panel from said pair of planer side panels and lock the removal of said back panel from said second set of registerable slots, thereby locking said collapsible furniture together in an assembled configuration.

2. The improved collapsible furniture of claim 1, wherein said seat panel includes a rearward extending portion and wherein said aperture is defined by said rearward extending portion.

3. The improved collapsible furniture of claim 1, wherein said pair of resilient locking barbs must be pressed towards one another to be removed from said aperture to facilitate disassembly of said furniture.

4. The improved collapsible furniture of claim 3, wherein said furniture is selected from the group consisting of a chair, a rocking chair, a beach chair, and a combined desk and chair.

5. The improved collapsible furniture of claim 3, further comprising:

a pair of arm rest panels, each one of said pair of arm rest panels separately interlocked with one of said pair of planer side panels.

6. The improved collapsible furniture of claim 5, wherein each panel of said pair of planer side panels includes resilient barb extending upward therefrom; and wherein each arm rest panel of said pair of arm rest panels defines an aperture which is adapted to receive said resilient barb extending upward from said planer said panel to positively lock said arm panel to said planer side panel.

7. The improved collapsible furniture of claim 6, wherein said pair of arm rest panels each include a cup receiving hole formed therethrough.

8. The improved collapsible furniture of claim 1, further comprising:

at least one decalcomania; and wherein each of said pair of planer side panels are shaped to resemble an animal and said at least one decalcomania including feature details of said animal and is attached to one of said pair of planer side panels.

9. The improved collapsible furniture of claim 8, wherein said seat panel defines a plurality of apertures for receiving said pair of resilient locking barbs extending from said back panel, further wherein said pair of resilient barbs are selectively inserted into one of said plurality of apertures so as to allow selective positioning of said back panel along said seat panel.

10. The improved collapsible furniture of claim 1, wherein said seat panel includes a plurality of slots formed through a center portion thereof;

wherein said back panel includes a plurality of slots formed through a center portion thereof; and further wherein said plurality of slots formed through said center portion of said seat panel and said slots formed through said center portion of said back panel are venting slots.

* * * * *